US007334912B1

(12) United States Patent
Chung

(10) Patent No.: US 7,334,912 B1
(45) Date of Patent: Feb. 26, 2008

(54) DECORATIVE SHINING BELT FOR PATTERNED SKELETONS

(76) Inventor: Hung-Huei Chung, 13F-2, No. 122, Sec. 2, Chung Shan Road, Chung Ho City, Taipei Shien (TW)

( * ) Notice: Subject to any disclaimer, the term of this patent is extended or adjusted under 35 U.S.C. 154(b) by 0 days.

(21) Appl. No.: 11/512,280

(22) Filed: Aug. 30, 2006

(51) Int. Cl.
*F21V 33/00* (2006.01)

(52) U.S. Cl. ..... 362/124; 362/808; 362/320; 362/346; 362/252; 362/249

(58) Field of Classification Search ..... 362/808, 362/806, 565, 124, 320, 343, 346, 252, 249, 362/122
See application file for complete search history.

(56) References Cited

U.S. PATENT DOCUMENTS

| | | | | |
|---|---|---|---|---|
| 6,352,355 | B1 * | 3/2002 | Law | 362/253 |
| 6,820,996 | B1 * | 11/2004 | Fan | 362/121 |
| 7,048,404 | B2 * | 5/2006 | Pan | 362/108 |
| 7,128,445 | B1 * | 10/2006 | Karkay | 362/343 |
| 2001/0043472 | A1 * | 11/2001 | Gibboney, Jr. | 362/240 |

* cited by examiner

*Primary Examiner*—Laura Tso
(74) *Attorney, Agent, or Firm*—Rosenberg, Klein & Lee

(57) ABSTRACT

The invention relates to an improved decorative shining belt for a patterned skeleton, which includes a patterned skeleton with a light string. A shining belt having many reflective pieces is also winded on the skeleton and is interlaced with the light string. Hence, the bulbs and the reflective pieces can emit rays outward at the same time that obtains a perfect decorative shining effect without increasing bulbs.

4 Claims, 6 Drawing Sheets

DECORATIVE SHINING BELT FOR PATTERNED SKELETONS

BACKGROUND OF THE INVENTION

In order to provide a good decorative effect, some patterned skeletons are designed, for example a deer skeleton (1) as shown in FIG. 1. A light string is winded on the skeleton (1) and bulbs (2) of the string emit rays outward to display the patterned outlook of the skeleton (1) that reaches the preset decorative purpose, especially at night. But in the conventional design, if the bulbs (2) are not enough, the lighting effect of the patterned skeleton will be poor. If more bulbs (2) are provided, the cost will be high and it increases the total weight that is a burden to the patterned skeleton. Further, power supplier will become another problem.

SUMMARY OF THE INVENTION

It is an object of the present invention to provide an improved decorative design for patterned skeletons to overcome the drawback of prior art, which includes a shining belt for winding on the patterned skeleton and obtains a perfect lighting effect. Now, accompanying with the following drawings, the character of the present invention will be described here and after.

DETAILED DESCRIPTION OF THE PREFERRED EMBODIMENT

Figure 1:
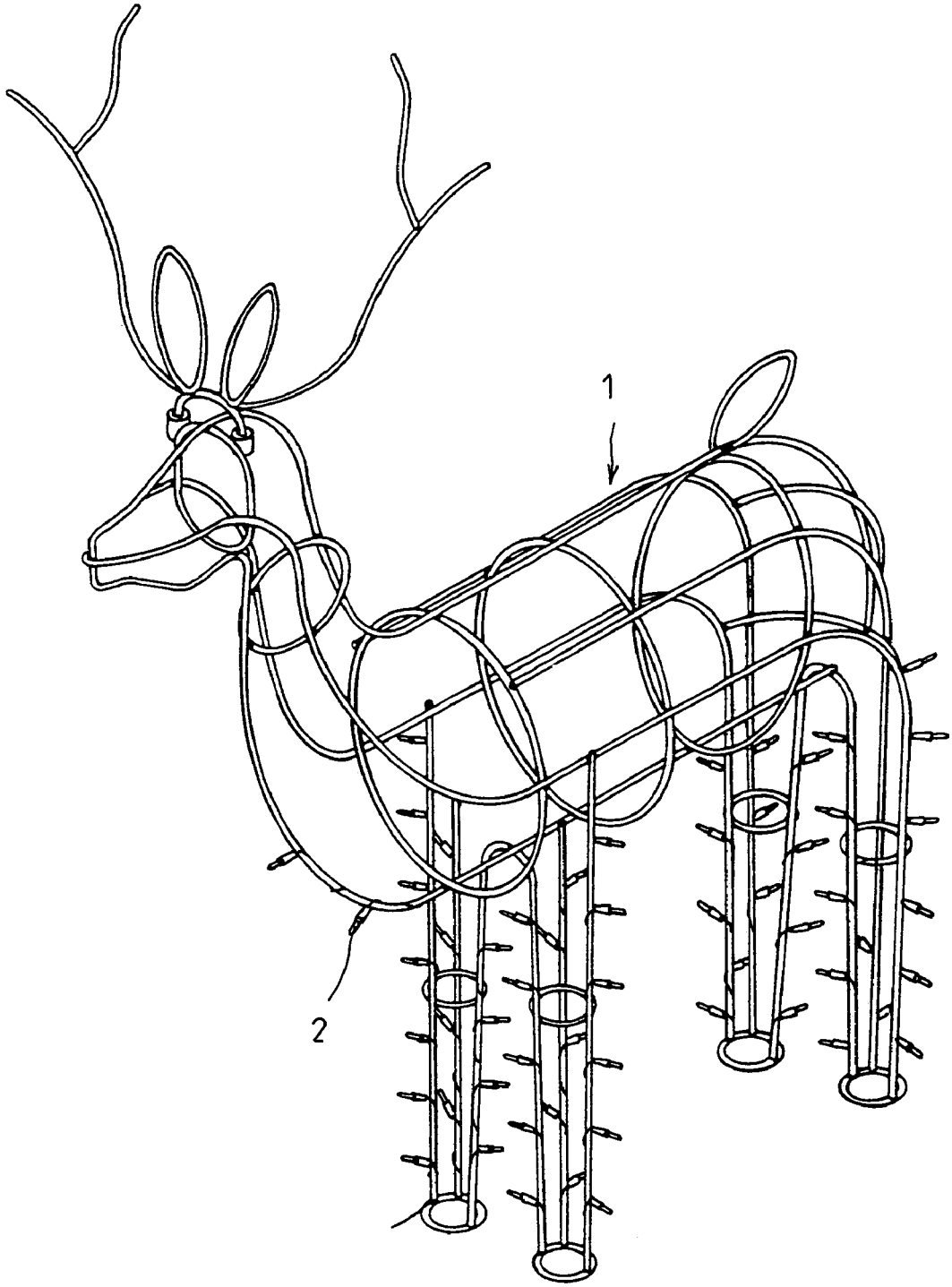
FIG. 1 (prior art)
FIG. 1 is a perspective view showing a conventional patterned skeleton (deer) with a light string.
Figure 2:
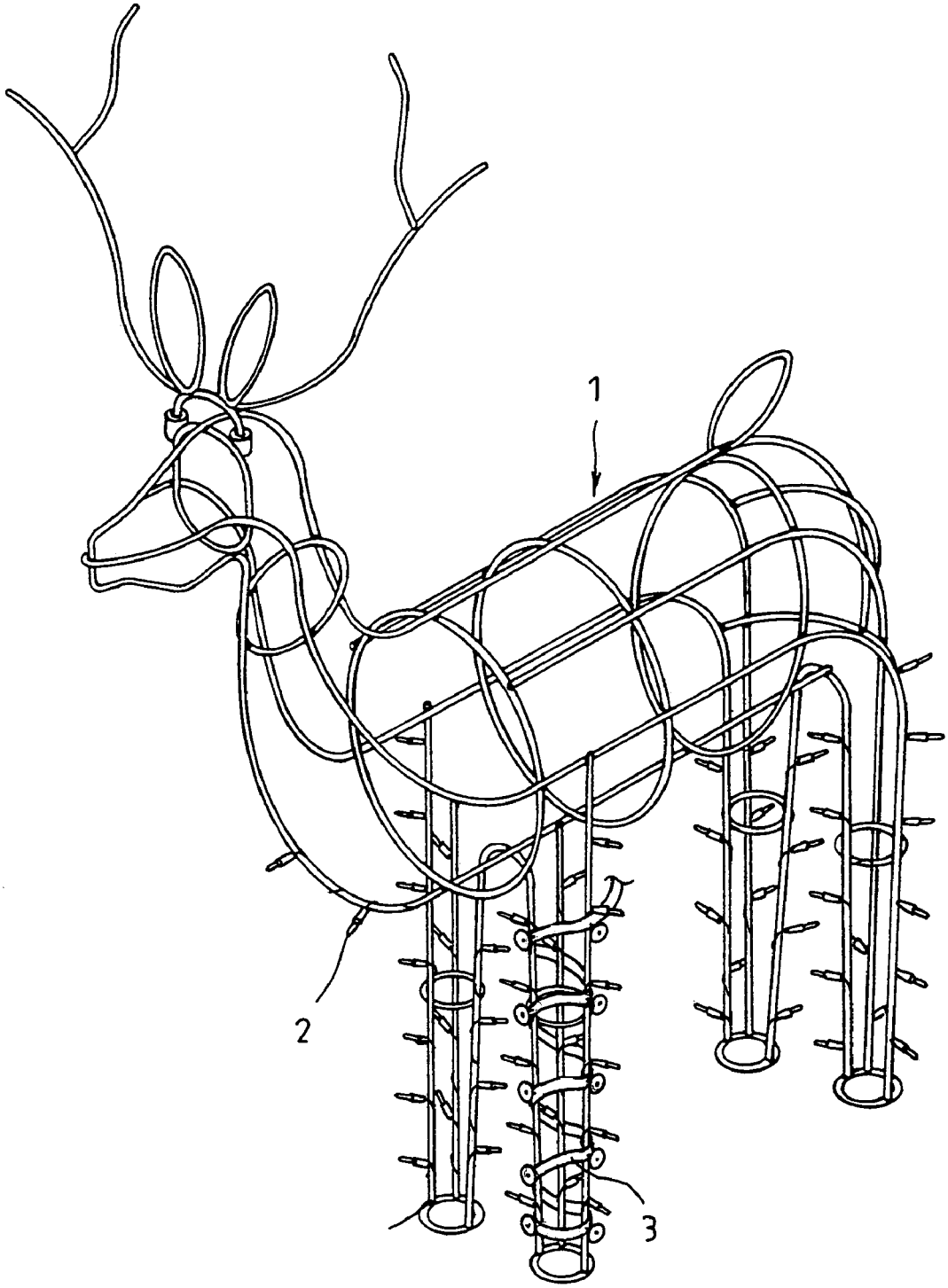
FIG. 2 is a perspective view showing an embodiment of a patterned skeleton (deer) with a shining belt according to the present invention.
Figure 3:
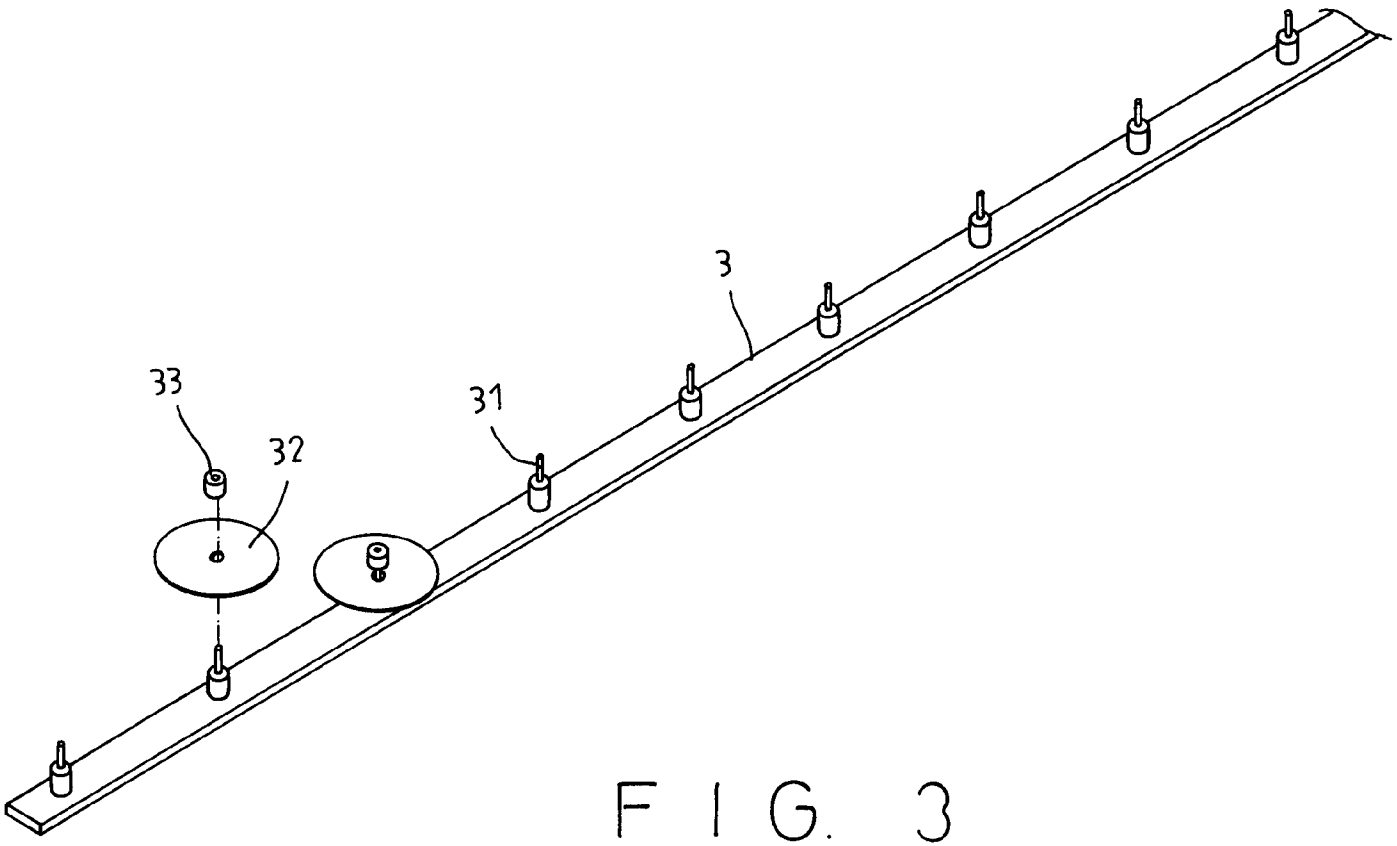
FIG. 3 is a perspective view showing the shining belt according to the present invention.
Figure 4:
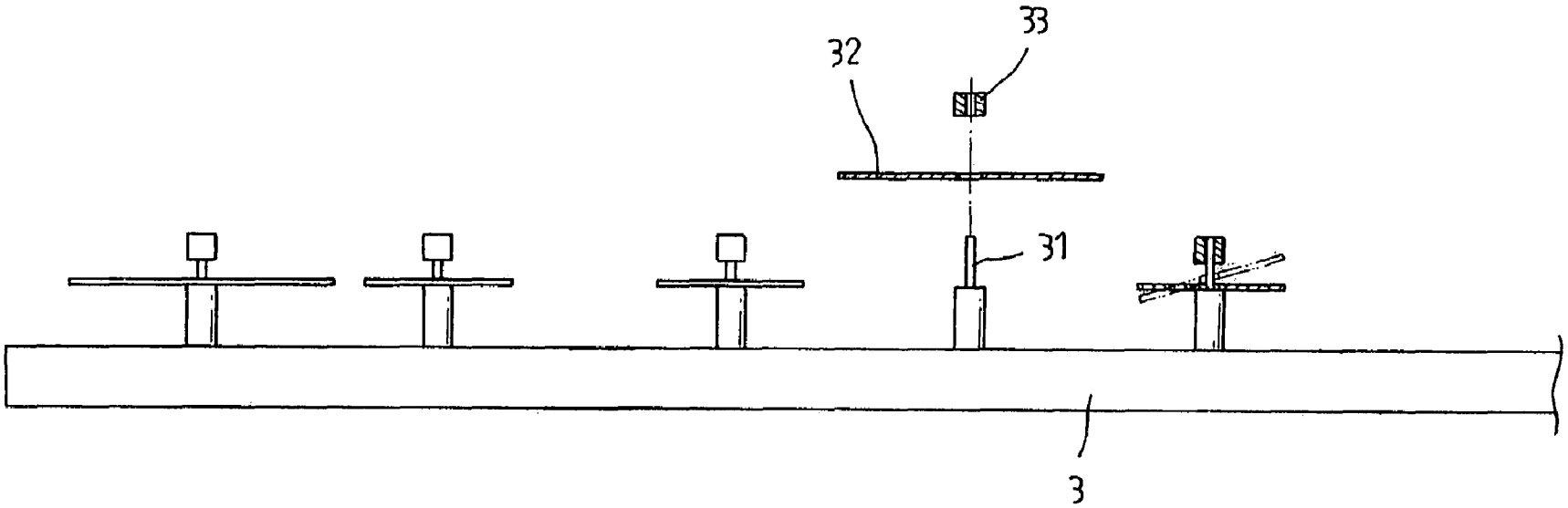
FIG. 4 is a plan view of FIG. 3 showing partial cross sections of the shining belt.

The present invention relates to a decorative shining belt for patterned skeleton, which includes a skeleton (1) with a winded light string, as shown in FIG. 2. Bulbs (2) of the string (1) are placed on the skeleton (1). The character of the present invention is in that a shining belt (3) is winded on the skeleton (1), as shown in FIGS. 3 and 4, wherein the shining belt (3) interlaces the light string (2). The belt (3) is provided with interval rod (31) to connect a reflective piece (32) and a cap (33), in which the reflective piece is capable of swinging.

In use, the bulb (2) emits rays outward directly and the reflective piece (32) can reflect rays of the bulb (2) at the same time. Hence, the skeleton (1) connected the shining belt (2) of the present invention displays a better lighting effect. Accompanying with the swinging piece (32), the patterned skeleton (1) can obtain a best shining decorative effect without using a lot of bulbs (2).

Figure 5:
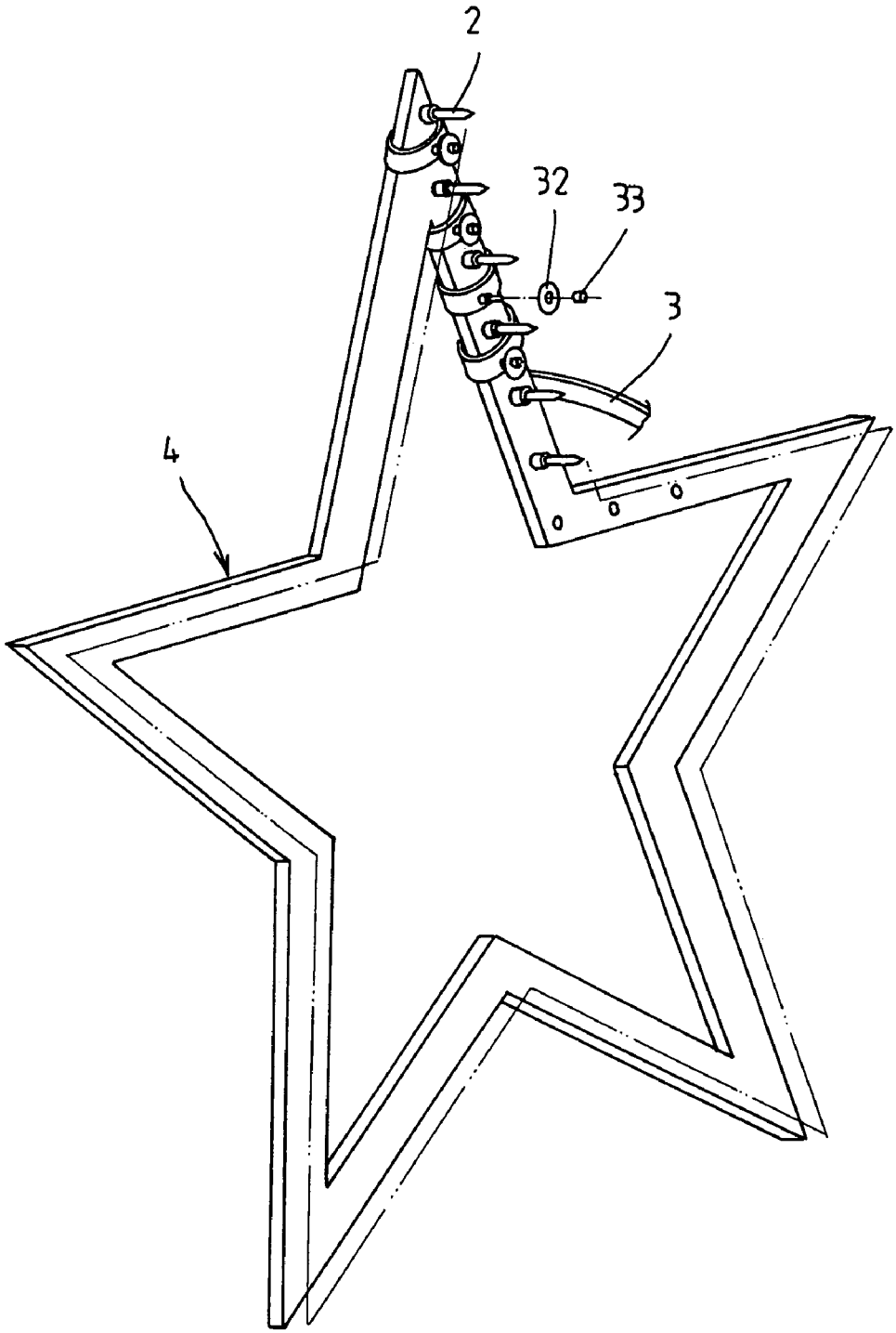
FIG. 5 is a perspective view showing another embodiment of a patterned skeleton (star) according to the present invention.
Figure 6:
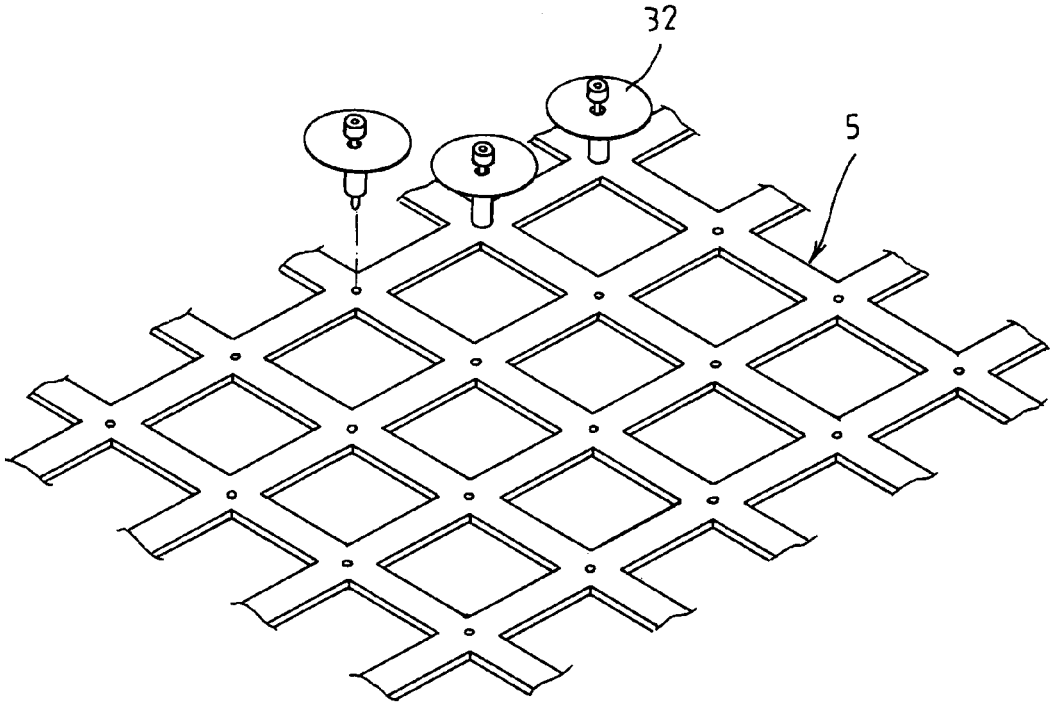
FIG. 6 is a perspective view showing a modified structure of a shining net according to the present invention.

As mentioned above, it is an object of the present invention to use a shining belt for winding a skeleton, wherein the belt has many reflective pieces for increasing the lighting effect. It should be understood that the patterned skeleton could be formed as desire, such as a star (4) shown in FIG. 5. Moreover, FIG. 6 shows a modified structure of the shining belt, which is formed a net (5) with several reflective pieces (32) thereon. The shining net (5) having a large area can cover a skeleton easily and directly for convenient assembly.

Hence, the present invention obtains improved utilization and should be allowed for a patent.

I claim:

1. A decorative patterned skeleton comprising:

a skeleton with a light string having bulbs being wound thereon; and a shining belt wound on the skeleton, the shining belt being interlaced with the light string and having a plurality of interval rods disposed at spaced intervals thereon and a plurality of reflective pieces angularly displaceably mounted on a respective one of the plurality of interval rods, each reflective piece being retained on the respective interval rod with a corresponding a cap.

2. The decorative patterned skeleton as claimed in claim 1, wherein the skeleton has frames for receiving the light string and the interlaced shining belt.

3. The decorative patterned skeleton as claimed in claim 1, wherein the reflective pieces reflect light rays from the bulbs outwardly.

4. A decorative patterned skeleton comprising:

a skeleton with a light string having bulbs being wound thereon; and a net covering the skeleton the net having a plurality of interval rods disposed at spaced intervals longitudinally and laterally thereon and a plurality of reflective pieces angularly displaceably mounted on a respective one of the plurality of interval rods, each reflective piece being retained on the respective interval rod with a corresponding a cap.

* * * * *